United States Patent [19]

Auckenthaler

[11] Patent Number: 4,505,769

[45] Date of Patent: Mar. 19, 1985

[54] METHOD AND APPARATUS FOR MAKING A WRAPPER SLEEVE

[75] Inventor: Robert Auckenthaler, Schaffhausen, Switzerland

[73] Assignee: SIG Schweizerische Industrie-Gesellschaft, Neuhausen am Rheinfall, Switzerland

[21] Appl. No.: 569,029

[22] Filed: Jan. 9, 1984

[30] Foreign Application Priority Data

Jan. 18, 1983 [CH] Switzerland ..... 271/83

[51] Int. Cl.[3] ..... B31B 1/52; B31B 1/26; B29D 23/10

[52] U.S. Cl. ..... 156/217; 156/443; 493/269; 493/295; 493/302

[58] Field of Search ..... 156/203, 215, 217, 218, 156/443, 466; 493/152, 153, 175, 189, 197, 252, 253, 271, 272, 269, 276, 295, 296, 302; 53/550

[56] References Cited

U.S. PATENT DOCUMENTS 4,242,949 1/1981 Auckenthaler ..... 493/295

FOREIGN PATENT DOCUMENTS 1254005 11/1967 Fed. Rep. of Germany ..... 493/252
2000570 11/1979 Fed. Rep. of Germany .
373947 1/1964 Switzerland .

*Primary Examiner*—Edward Kimlin
*Assistant Examiner*—Ramon R. Hoch
*Attorney, Agent, or Firm*—Spencer & Frank

[57] ABSTRACT

A wrapper sleeve is made from a film length in the following consecutive steps: wrapping the film length about a sealing mandrel such that opposite longitudinal edge zones of the film length are in a face-to-face oriented relationship; providing a sealing seam in and along the face-to-face oriented longitudinal edge zones for bonding the edge zones to one another whereby a wrapper sleeve is formed; and removing the wrapper sleeve from the sealing mandrel and inserting the wrapper sleeve on a forming mandrel having a circumferential length identical to that of the sealing mandrel and a cross-sectional shape different from that of the sealing mandrel.

12 Claims, 5 Drawing Figures

METHOD AND APPARATUS FOR MAKING A WRAPPER SLEEVE

BACKGROUND OF THE INVENTION

This invention relates to a method and an apparatus for making wrapper sleeves from preferably heat sealable film sheet lengths by providing thereon a longitudinal seam, particularly a fin seal for bonding together opposite longitudinal edges of the film sheet.

It is known to make wrapper sleeves from individual film lengths. For forming the sleeve, the film length is wrapped around a forming mandrel and a longitudinal seam is formed by means of sealing shoes movable towards one another. In this process it is of advantage to make the forming mandrel part of a mandrel wheel so that the sleeve wrapper packages may be manufactured stepwise in simultaneously operating different stations. This results in a high machine output.

Machines of the above-outlined type have, in particular, two disadvantages which set limits to the machine output: first, the welding of the longitudinal seam is carried out in a station where a necessary dwelling period has to be observed. Second, the machine components have to execute relatively complex motions for wrapping the film material about the forming mandrel. Such machines are disclosed, for example, in Swiss Pat. No. 373,947 and German Auslegeschrift (application published after examination) No. 2,000,570.

According to Swiss Pat. No. 373,947, a wrapper film of cut length is positioned on a table formed of two elements of a forming box and is then brought into the correct position by means of lateral holders. A plunger situated between the two elements is, together with the elements, raised, whereby the film is folded about a mandrel. The edge portions of the film projecting beyond the mandrel are of unequal length. Two heated sealing shoes are pivoted towards one another, whereby the longer edge portion is folded over onto the shorter edge portion in such a manner that the two edge portions may be welded (heat-sealed) to one another. It is a disadvantage of this arrangement that the folding elements have to execute a relatively large stroke and the plunger situated therebetween executes only a small stroke. Further, an additional folding operation has to be performed with one of the sealing shoes. The tip of the sealing shoe with which the longer edge portion is folded lies against the mandrel and thus heats, in addition to the sealing seam, film portions that may be damaged by such a heat effect.

According to German Auslegeschrift No. 2,000,570 the portions of the film to be folded about the mandrel are lifted by pressurized air before folding forks press these film portions against the mandrel. The film edges project freely beyond the folding forks and may flutter in the airstream which may lead to malfunctions. Here too, the sealing shoes may damage portions adjacent the sealing seam in case the seal has to be provided close to the mandrel. In a sleeve package, however, it is of importance that the walls lie fully against the contents so as not to generate the impression of a loose package. For this reason, the welded seam has to provided close to the mandrel.

SUMMARY OF THE INVENTION

It is an object of the invention to provide an improved method and apparatus of the above-outlined type with which the cycling (frequency of periodic operation) of the machine is increased and wherein the sealing seam is provided on the film close to the mandrel without risking heat-caused damage to film portions adjacent the sealing seam.

This object and others to become apparent as the specification progresses, are accomplished by the invention, according to which, briefly stated, the film length is first wrapped about a sealing mandrel which has the same circumference as the intended circumference of the wrapper sleeve but has a shape different therefrom; then the sealing seam if formed and thereafter, the sleeve so obtained is drawn off the sealing mandrel and inserted on a shaping mandrel.

The novel apparatus for performing the method outlined above comprises an elongated sealing mandrel having a longitudinal sealing edge, a folding device for wrapping the film length about the sealing mandrel and for positioning edge zones of the film in a face-to-face orientation immediately at the sealing edge; a sealing device for providing a longitudinal sealing seam on the edge zones immediately along the sealing edge of the sealing mandrel to form a wrapper sleeve from the film length; and an elongated forming mandrel extending spaced from and generally in longitudinal alignment with the sealing mandrel. The forming mandrel has a circumferential length equalling that of the sealing mandrel and a cross-sectional shape different from that of the sealing mandrel. The apparatus further has an arrangement defining a plurality of guiding edges extending from the sealing mandrel to the forming mandrel. To each mandrel edge of the forming mandrel there leads a separate guiding edge. A mechanism pulls the wrapper sleeve off the sealing mandrel onto the forming mandrel through the guide edges.

DESCRIPTION OF THE PREFERRED EMBODIMENTS

Figure 1:
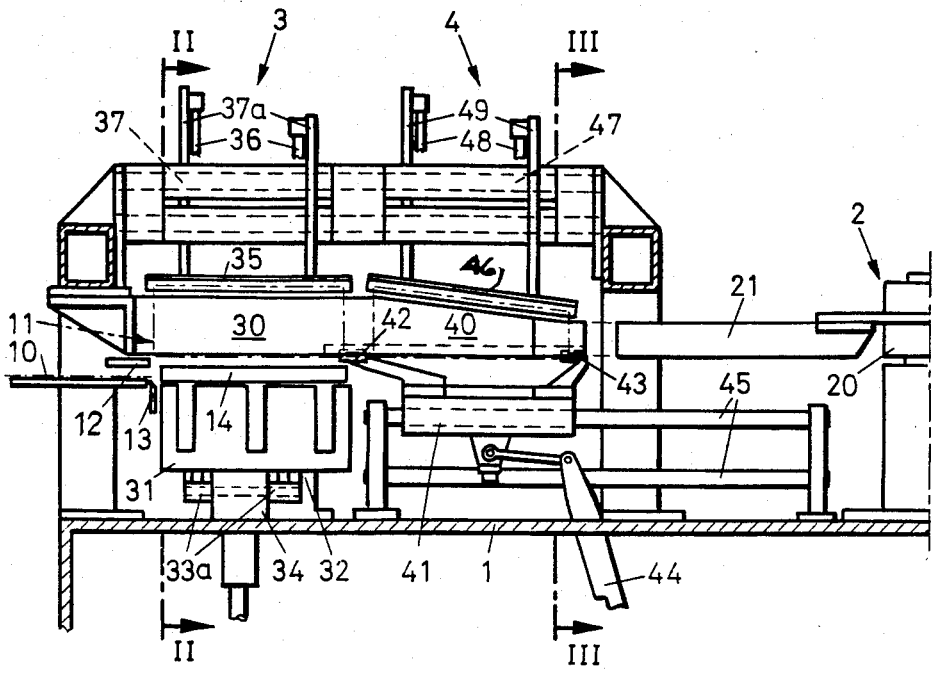
FIG. 1 is a schematic top plan view, partially in section, of a preferred embodiment of the invention.
Figure 2:
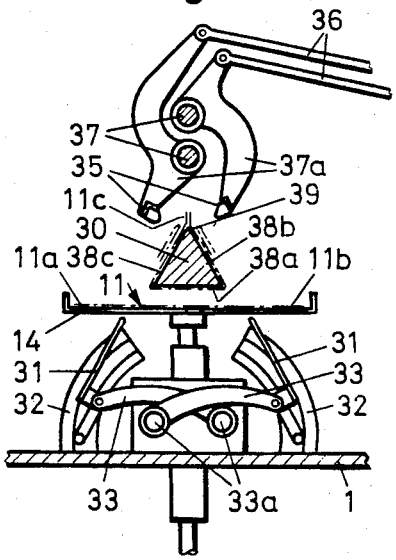
FIG. 2 is a sectional view taken along line II—II of FIG. 1.

Turning now to FIG. 1, the apparatus shown therein comprises a mandrel wheel 2 which has a central hub 20 from which individual forming (shaping) mandrels 21 (only one shown) extend radially. Externally of the mandrel wheel 2, on a machine stand 1 there are arranged a sealing station 3 and a reshaping station 4. In the sealing station 3 a film length 11 is severed by scissors 12, 13 from a film web 10. Above a film supporting table 14 there is accurately centrally arranged a prismatic sealing mandrel 30 which has a triangular cross section as seen in FIG. 2.

Underneath the film supporting table 14 there are arranged two lateral side folders 31 controlled by cam discs 32 as well as drive levers 33 which are articulated by means of a respective pivot 33*a* to a vertically movable drive block 34. The film supporting table 14 is situated at a distance below the sealing mandrel 30 and is vertically reciprocated by the drive block 34. Above the sealing mandrel 30 there is arranged a pair of sealing shoes 35 which are supported on pivots 37 mounted in the machine stand. The sealing shoes 35 may be oscillated towards and away from one another by a lever pair 37*a* to which there are jointed respective drive levers 36. The drive block 34 and the drive levers 36 are actuated in a known manner by cam discs with follower lugs or follower rollers from a single drive. Such drive means are well known in the packaging industry and therefore details of such drive are not described or illustrated in detail.

The film length 11 on the film supporting table 14 is, by means of lifting the film table 14, pressed against the lower face 38*a* of the sealing mandrel 30 and, at the same time, edge portions 11*a* and 11*b* of the film length 11 are pressed, by means of the lateral side folders 31, against the two other faces 38*b* and 38*c* of the sealing mandrel 30. At the upper mandrel edge (sealing edge) 39 the edges 11*c* of the film length 11 are oriented vertically upwardly and are in a face-to-face contact with one another. The two sealing shoes 35 which may be heated electrically in a conventional manner, need to be only slightly moved towards one another and may seal the edges 11*c* along their entire height.

Since the film portions are held away from the sealing edge 39 in a downward orientation along the faces 38*b* and 38*c* of the sealing mandrel 30, these film parts do not contact the sealing shoes 35 and thus damage thereto is avoided even if sealing is effected in the immediate vicinity of the sealing mandrel 30.

Next to the sealing station 3 there is provided a reshaping station 4 which has means for transforming the triangular cross-sectional outline of the sealed wrapper sleeve to the desired shape. Such a reshaping may be effected by means of a reshaping mandrel 40 which has, as will also be discussed in connection with FIG. 4, two edges that diverge from the longitudinal end of the sealing edge 39 of the sealing mandrel 30 to a location where the distance between the two edges equals the width of the bottom face 38*a* of the sealing mandrel 30. Underneath the reshaping mandrel 40 there is arranged a gripper carriage 41 which is movable radially with respect to the mandrel wheel 2 and which has two grippers 42 and 43 for grasping and displacing the wrapper sleeve. By means of the gripper 42 the sleeve is pulled from the sealing mandrel 30 onto the reshaping mandrel 40 while, at the same time, by means of the other gripper 43, the sleeve is pulled from the reshaping mandrel 40 onto the momentarily aligned mandrel 21 of the mandrel wheel 2. The motion of the gripper carriage 41 which travels on a carriage guide 45, is effected by means of a drive lever 44.

Reverting in particular to FIG. 2, the width of the sealing shoes 35 is so dimensioned relative to the width (height) of the face-to-face arranged edge portions 11*a* and 11*b* that the sealing seam 11*c* is provided by the sealing shoes 35 only immediately along the sealing edge 39 of the sealing mandrel 30, thus leaving an outer longitudinal part of the edge portions 11*a* and 11*b* unsealed. Also referring now to FIG. 3, above the reshaping mandrel 40 there is arranged a second pair of sealing shoes 46 which are supported on a pivot 45 mounted in the machine stand and which are movable by a lever pair 49. The sealing shoes 46 are movable back and forth between an open and a closed position by drive rods 48. The sealing shoes 46 are so positioned with respect to the reshaping mandrel 40 that they seal together only the outer parts of the edge zones 11*a*, 11*b*, which had not been sealed by the sealing shoes 35. Thus, the sealing shoes 46 may be maintained at a safe distance from wrapper parts adjoining the edge zones 11*a*, 11*b* since a first sealing seam had already been provided along the longitudinal root of the edge zones 11*a*, 11*b* in the sealing station 3 (in a manner which also did not endanger parts of the wrapper sleeve).

The drive levers 44 of the gripper carriage 41, the lever pair 49 with the grippers 42 and 43 as well as the drive rods 48 of the sealing shoes 46 are driven in a conventional manner by means of a cam disc and follower roller drive (not shown).

It is thus seen that, as viewed in the sequence of material handling, upstream of the mandrel 21 of the mandrel wheel 2 two processing stations 3 and 4 are located. Since in each station 3 and 4 the seal may be provided in an optimal manner without a need to take into consideration adjacent portions of the wrapper, there may be achieved an optimal sealing time which is shorter than it has been possible heretofore. In this manner, the cycling of the mandrel wheel 2 may be shortened and further, the quality of the sealing seam may be significantly improved.

Figure 3:
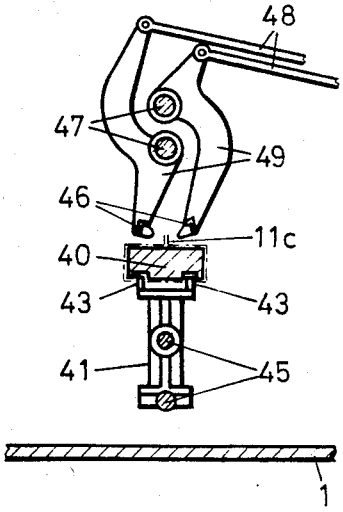
FIG. 3 is a sectional view taken along line III—III of FIG. 1.
Figures 4, 5:
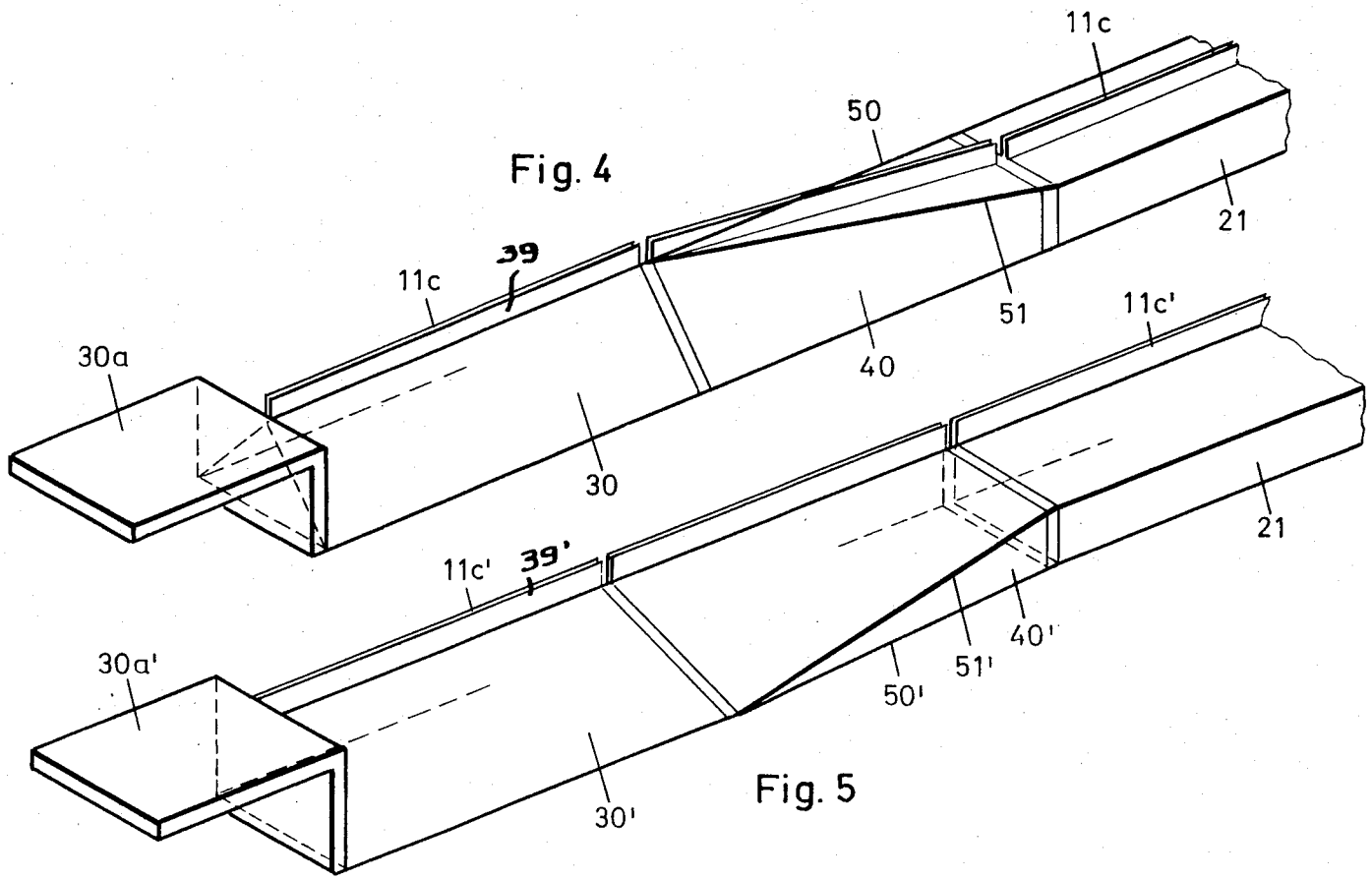
FIG. 4 is a perspective view of components of the preferred embodiment.
FIG. 5 is a perspective view of another preferred embodiment of the same components.

FIG. 4 is a perspective illustration of the mandrel configuration of the embodiment shown in FIGS. 1, 2, and 3, comprising three serially arranged mandrels, namely, the sealing mandrel 30, the reshaping mandrel 40 and the forming mandrel 21. In this embodiment the sealing mandrel 30 is of prismatic shape having the cross-sectional outline of an isosceles or equilateral triangle. At the reshaping mandrel 40 the upper longitudinal edge 39 of the sealing mandrel 30 changes into two divergent guiding edges 50 and 51 so that eventually a prismatic sleeve of rectangular cross-sectional outline is obtained. The angle formed by the guiding edges 50, 51 is halved by an imaginary plane containing the sealing edge 39 and oriented perpendicular to the base 38*a* of the sealing mandrel 30. The sealing seam 11*c* remains centrally located on the wide sleeve surface.

Turning now to FIG. 5, there is shown another preferred embodiment of the serially arranged mandrels. In this embodiment, the prismatic sealing mandrel 30' has a cross-sectional outline of a right-angled triangle. The upper edge 39' where the sealing seam 11*c'* is formed continues as a single edge with unchanged orientation both in the reshaping mandrel 40' and in the forming mandrel 21. As a result, the sealing seam 11*c'* is situated laterally. The sealing edge 39*a'* of the sealing mandrel 30' changes into two guiding edges 50' and 51' which form part of the reshaping mandrel 40' and which defines a lateral face flush with a lateral face of the foming mandrel 21.

It is seen that adjacent the sealing mandrel the reshaping mandrel has a cross-sectional shape identical to that of the sealing mandrel and adjacent the forming mandrel the reshaping mandrel has a cross-sectional shape indentical to that of the forming mandrel. The reshaping of the wrapper sleeve is effected by the guiding edges of the reshaping mandrel; to each mandrel edge of the forming mandrel there leads a guiding edge of the reshaping mandrel.

It is to be understood that the sealing mandrel and reshaping mandrel may have other appropriate shapes. It is in each instance of importance that at the sealing station 3 the sealing shoes 35 may practically lie against the sealing mandrel 30 and that the sealing seam 11 does not change its orientation during reshaping.

It will be understood that the above description of the present invention is susceptible to various modifications, changes and adaptations, and the same are intended to be comprehended within the meaning and range of equivalents of the appended claims.

What is claimed is:

1. A method of making a wrapper sleeve from a film length comprising the following consecutive steps:

(a) wrapping the film length about a sealing mandrel such that opposite longitudinal edge zones of the film length are in a face-to-face oriented relationship; said sealing mandrel having a circumferential length, a cross-sectional shape and a longitudinal sealing edge formed by two intersecting sides of the sealing mandrel; said wrapping step comprising the step of placing the opposite longitudinal edge zones in said face-to-face oriented relationship immediately beyond said sealing edge;

(b) providing a sealing seam in and along the face-to-face oriented longitudinal edge zones for bonding said edge zones to one another whereby a wrapper sleeve is formed; and (c) removing the wrapper sleeve from said sealing mandrel and inserting said wrapper sleeve on a forming mandrel having a circumferential length identical to that of said sealing mandrel and a cross-sectional shape different from that of said sealing mandrel.

2. A method as defined in claim 1, further comprising the step of inserting the wrapper sleeve on a reshaping mandrel subsequent to removal from the sealing mandrel and prior to insertion on said forming mandrel; said reshaping mandrel having a circumferential length equalling that of said sealing mandrel and removing the wrapper sleeve from said reshaping mandrel and inserting the wrapper sleeve on said forming mandrel.

3. A method as defined in claim 1, wherein step (b) includes the step of sealing together said edge zones along and immediately adjacent said sealing edge, while leaving longitudinal outer edge zone portions of the face-to-face oriented edge zones unsealed; and further comprising the step of providing, subsequent to removing the wrapper sleeve from said sealing mandrel, an additional sealing seam in and along the face-to-face oriented longitudinal edge zones for bonding said longitudinal outer edge zone portions left unsealed during the performance of step (b).

4. A method as defined in claim 1, wherein step (b) includes the step of sealing together said edge zones along and immediately adjacent said sealing edge, while leaving longitudinal outer edge zone portions of the face-to-face oriented edge zones unsealed; further comprising the step of inserting the wrapper sleeve on a reshaping mandrel subsequent to removal from the sealing mandrel and prior to insertion on said forming mandrel; said reshaping mandrel having a circumferential length equalling that of said sealing mandrel; providing, while said wrapper sleeve is on said reshaping mandrel, an additional sealing seam in and along the face-to-face oriented longitudinal edge zones for bonding said longitudinal outer edge zone portions left unsealed during the performance of step (b); and removing the wrapper sleeve from said reshaping mandrel and inserting the wrapper sleeve on said forming mandrel.

5. An apparatus for making a wrapper sleeve from a film length having opposite longitudinal edges each bounding a longitudinal edge zone, comprising:

(a) an elongated sealing mandrel having a circumferential length, a cross-sectional shape and a surface including a longitudinal sealing edge formed by two intersecting sides of said sealing mandrel;

(b) folding means for wrapping the film length about said sealing mandrel and for positioning said edge zones in a face-to-face orientation immediately at said longitudinal sealing edge;

(c) sealing means for providing a longitudinal sealing seam on said edge zones immediately along said sealing edge to form a wrapper sleeve from said film length;

(d) an elongated forming mandrel extending spaced from and generally in longitudinal alignment with said sealing mandrel; said forming mandrel having a circumferential length equalling that of said sealing mandrel, a cross-sectional shape different from that of said sealing mandrel and a plurality of longitudinal mandrel edges;

(e) means defining a plurality of guiding edges extending from said sealing mandrel to said forming mandrel; to each said mandrel edge of said forming mandrel there leads a separate said guiding edge; and (f) means for pulling said wrapper sleeve off said sealing mandrel onto said forming mandrel through said guiding edges.

6. An apparatus as defined in claim 5, wherein said sealing mandrel has a triangular cross section.

7. An apparatus as defined in claim 5, wherein said sealing mandrel has a cross-sectional shape of a right-angled triangle, and said forming mandrel has a cross-sectional shape of a rectangle; further wherein a first of said guiding edges constitutes an aligned continuation of said sealing edge; said sealing mandrel having a further mandrel edge; further wherein a second and a third of said guiding edges extend from a common point adjacent said further mandrel edge of said sealing mandrel to two edges of said forming mandrel.

8. An apparatus as defined in claim 5, wherein said forming mandrel is present in a plurality; further comprising a wheel radially supporting each forming mandrel; said wheel being rotatable for aligning in sequence the forming mandrels with said guide edges.

9. An apparatus as defined in claim 5, wherein said means defining said guiding edges comprises a body on which said guiding edges are formed by intersecting sides of said body; further comprising additional sealing means cooperating with said body for providing a longitudinal sealing seam on said edge zones parallel to and spaced from said body while the wrapper sleeve is supported on said body.

10. An apparatus as defined in claim 5, wherein a first and a second of said guiding edges extend from a common point adjacent said sealing edge to two mandrel edges of said forming mandrel.

11. An apparatus as defined in claim 10, wherein said sealing mandrel has a triangular cross section and further wherein said means defining a plurality of guiding edges are formed on an elongated body having a triangular cross section adjacent said sealing mandrel and a quadrilateral cross section adjacent said forming mandrel.

12. An apparatus as defined in claim 11, wherein said quadrilateral cross section is a rectangle and said two guiding edges form an angle which is halved by a plane containing said sealing edge and being perpendicular to a side of said sealing mandrel situated opposite said sealing edge.

* * * * *